US005344233A

United States Patent [19]

Barger

[11] Patent Number: 5,344,233

[45] Date of Patent: Sep. 6, 1994

[54] APPARATUS FOR DISPENSING HYDRATABLE MATERIAL

[75] Inventor: William E. Barger, Afton, Wyo.

[73] Assignee: J. R. Simplot Co., Pocatello, Id.

[21] Appl. No.: 60,238

[22] Filed: May 11, 1993

[51] Int. Cl.[5] ..... B01F 15/02

[52] U.S. Cl. ..... 366/165; 366/156

[58] Field of Search ..... 366/150, 165, 177, 178, 366/179, 181, 182

[56] References Cited

U.S. PATENT DOCUMENTS

| | | | |
|---|---|---|---|
| 3,047,275 | 7/1962 | Cox | 366/165 |
| 4,390,284 | 6/1983 | Hyde | 366/165 |
| 4,643,582 | 2/1987 | Ricciardi | 366/178 |

*Primary Examiner*—Robert W. Jenkins
*Attorney, Agent, or Firm*—Gregory Garmong

[57] ABSTRACT

An apparatus for dispensing a hydratable material includes a source of the hydratable material to be dispensed, including a container and a metering unit. A continuous-flow first mixer has a truncated conical mixing chamber with an open upper end and an open lower end of smaller diameter than the upper end. The upper end is disposed to receive the flow from the metering unit and the lower end delivers a flow of a mixture of the hydratable material and water. A plurality of water inlet openings at an upper end of an inner surface of the conical mixing chamber introduce water tangentially along the inner circumference of the cone to create a vortex effect within the cone. A continuous-flow second mixer is positioned directly adjacent to and below the first mixer and receives the flow of mixture from the first mixer. The second mixer includes at least one outlet opening of a size less than a preselected size, an impeller disposed to mix the mixture of hydratable material and water with high energy and force the mixture toward the outlet opening, and a motor that turns the impeller to have a tip speed of at least about 25 feet per second.

18 Claims, 3 Drawing Sheets

APPARATUS FOR DISPENSING HYDRATABLE MATERIAL

BACKGROUND OF THE INVENTION

This invention relates to the dispensing of a relatively small flow of a solid or liquid into a mass of fluid, and, more particularly, to the dispensing of an even, unagglomerated flow of a hydratable material.

In some mineral beneficiation processes, a flocculant is dispensed into a fluid to clarify the fluid of solids (including colloids) that are present in the fluid. The flocculant is a hydratable material that first is wetted by the fluid as it is mixed with the fluid, which is typically water or an aqueous solution. Ideally, the wetted flocculant thereafter chemically reacts with finely divided solids in the fluid to cause them to agglomerate into larger masses. The masses of flocculated solids are removed from the fluid by filtration or other suitable process.

The dispensing of the flocculant into the fluid sometimes presents some problems. In a typical case, the flocculant is a finely divided powder. The flocculant begins to absorb water and become wetted as soon as it contacts the fluid. However, at the same time its molecular structure changes In a manner comparable to polymerization so that it reacts with solids in the fluid to achieve the flocculation reaction. Since the wetting and chemical reactions are occurring generally simultaneously, the flocculant can sometimes itself agglomerate into masses, often termed "fisheyes" in the art, before it has a chance to react with the solids in the fluid. Any such self-agglomerated flocculant is not available to flocculate solids in the fluid, with the result that the flocculation treatment is only partially effective or is wasteful of the expensive flocculant material.

Existing techniques for dispensing flocculant seek to add the flocculant in a flow and rely upon achieving a degree of mixing of the flocculant with the fluid before the flocculant can self-agglomerate. However, it is found that this approach is often not successful, and flocculant lumps are observed in the fluid regardless of the care taken in adding the flocculant. There is therefore a need for an improved approach to dispensing such hydratable materials into fluid masses. The present invention fulfills this need, and further provides related advantages.

SUMMARY OF THE INVENTION

The present invention provides an apparatus and approach for dispensing hydratable solids or liquids into a fluid mass to achieve a dispersion of the hydratable material without self-agglomeration into ineffective masses. This approach saves upon the use of expensive hydratable material, and improves the effectiveness of the material that is used. The technique is suitable for dispensing the hydratable material into batches of the fluid or a continuous flow of the Fluid, and is effective to prevent the dispensing of fisheyes. The apparatus is readily constructed and easily operated in a production setting.

In accordance with the invention, an apparatus for dispensing a hydratable material comprises a source of the hydratable material to be dispensed and a continuous-flow first mixer. The first mixer comprises a hydratable material inlet and a water inlet, the hydratable material inlet and the water inlet being disposed to mix a flow of the hydratable material and a flow of water to produce a flow of a mixture of hydratable material and water. A continuous-flow second mixer is positioned directly adjacent to the first mixer and receives the flow of mixture from the first mixer. The second mixer includes at least one outlet opening of a size less than a preselected size, and an impeller disposed to mix the mixture of hydratable material and water and force the mixture toward the outlet opening. The second mixer is preferably a high-energy mixer wherein the impeller has a rotational tip speed of at least about 25 feet per second so as to achieve high shear of the mixture.

The low-energy first mixer preferably is formed as a truncated cone having an open upper end and an open lower end of smaller diameter than the upper end. The water inlet includes a plurality of openings at an upper end of an inner surface of the cone, disposed so as to introduce water tangentially along the inner circumference of the cone to create a vortex effect within the cone. The hydratable material is introduced into this vortex, where it is initially wetted by the water. This first mixer is necessary to achieve the initial wetting, inasmuch as the flocculant cannot spend too great a time in the second mixer.

The second mixer is preferably located vertically directly below the first mixer, so that the wetted mixture flows continuously from the first mixer into the second mixer. In the second mixer, the initially wetted mixture is mixed more thoroughly by the impeller and forced through the outlet openings into a tank containing the fluids to be treated with the flocculant. These outlet openings are sized to prevent passage of any self-agglomerated fisheyes that may form in the first and second mixers. Such self-agglomerated masses of the hydratable material are either pulverized to a sufficiently small size for passage through the outlet openings, or, in some cases, retained in the second mixer for later off-line removal. The second mixer is designed so that the mixture has a short residence time therein, to avoid damage to the flocculant molecules.

This approach overcomes the self-agglomeration problem often found in the art by achieving thorough wetting and hydration prior to the time that the flocculant achieves substantial molecular chain formation in the flocculation process. The apparatus initially forms the mixture of hydratable material and water in a smoothly flowing, low-energy environment of the first mixer. More vigorous mixing and a high degree of wetting are achieved in the high-energy environment of the second mixer. The total residence time for the flocculant in the first and second mixers is quite short, estimated to be about 1.5 seconds. Molecular chain formation has not occurred to any substantial degree at this point. By the time that the molecular chains of the flocculant begin to form, the thoroughly wetted and mixed flocculant is back in a low-energy environment, the flocculation tank, and in contact with the fluid to be treated by flocculation. Self-agglomeration is thereby minimized. In the few instances where some degree of self-agglomeration can occur, the resulting fisheyes are prevented from entering the fluid by the small-size outlet openings of the second mixer.

The present invention therefore provides an advance in the art of the dispensing of materials where wetting and chemical reaction may occur simultaneously. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
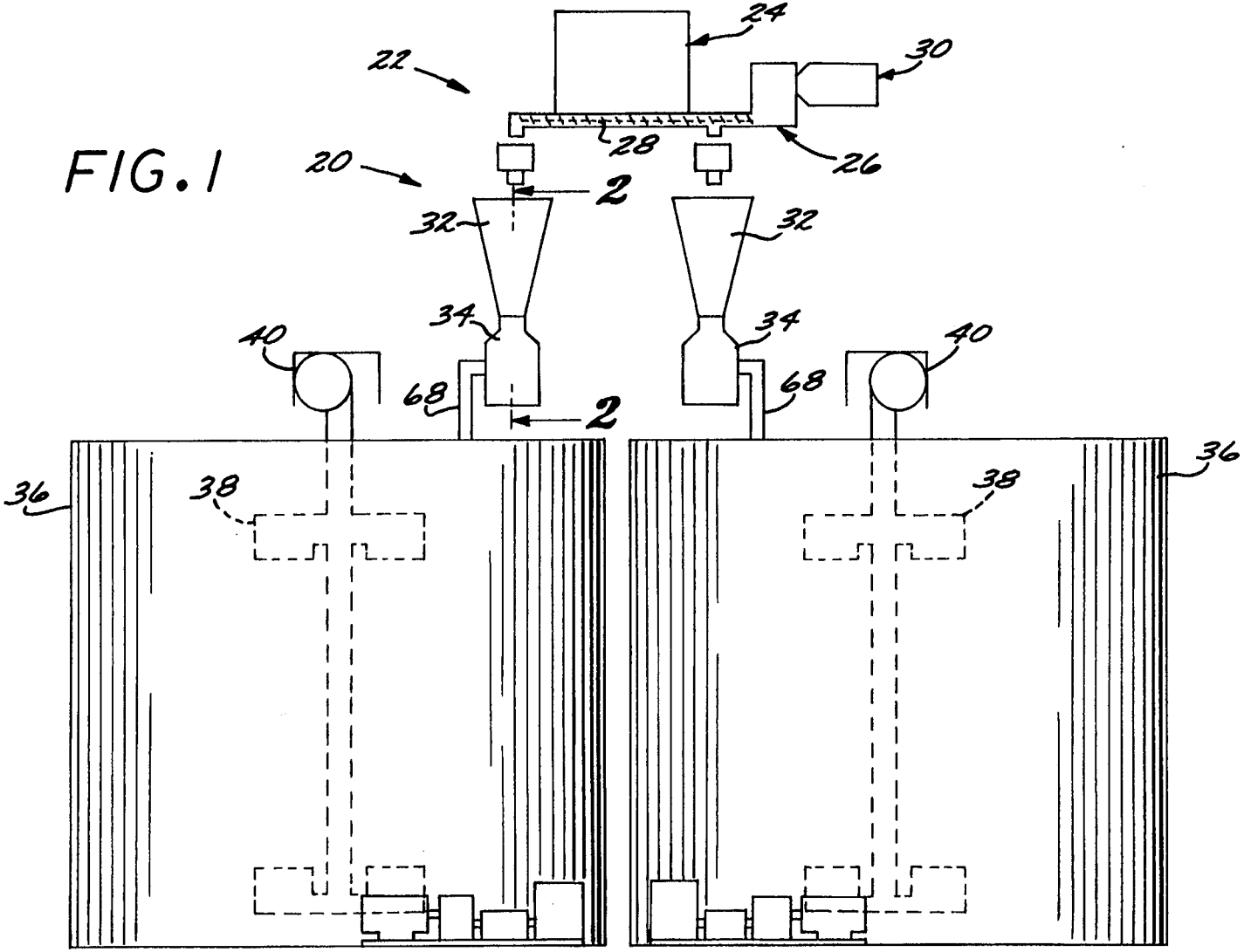
FIG. 1 is a schematic elevational view of the dispensing apparatus.

FIG. 1 illustrates a preferred dispensing apparatus 20 used to dispense a controlled flow of a solid particulate material. The preferred application of the apparatus 20 is in dispensing the hydratable flocculant copolymer of sodium acrylate and acrylamide, which is available commercially as Percol 919 from Allied Colloids, Inc. This flocculant is a solid powder. The following discussion is directed toward that use of the invention, but it is not so limited.

The apparatus 20 includes a source 22 of the material to be dispensed. The source 22 includes a container 24, such as the depicted bin, for holding a supply of the material. The source 22 also includes a metering unit 26 that transfers a controllable flow of the solid material from the container 24. The depicted metering unit includes an auger 28 fed from the bottom of the container and a reversible, variable speed motor 30 that drives the auger 28. The motor 30 is made reversible so that solid material can be selectively supplied to either of two identical mixer sections. The two mixer sections are used In an alternating fashion, for reasons that will be discussed subsequently.

The metering unit 26 supplies a controllable flow of the solid material being dispensed to a first mixer 32. The first mixer 32 is desirably disposed generally vertically below the container 24 so that the solid material falls from the metering unit 26 into the first mixer 32. In the first mixer 32 the flow of solid material is continuously mixed with a flow of a fluid, preferably water. The mixture continuously flows to a second mixer The second mixer 94 is positioned directly adjacent to the first mixer 22, and is desirably disposed vertically below the first mixer 32 so that the flow of the mixture of solid material and water falls directly from the first mixer 32 into the second mixer 34. After further mixing, the mixture continuously flows from the second mixer 24 to tank 36 wherein it is mixed with the fluid to be treated, by flocculation in this case. The fluid and flocculant in the tank 36 are continuously and slowly agitated by an impeller 38 driven by a motor 40.

The elements 22, 34, 36, 38, and 40 are duplicated in two separate mixer sections, in the preferred embodiment. These two sections are fed alternatively by the metering unit 26. This arrangement allows one of the tanks 36 to be in the dispensing portion of the flocculation treatment while the other of the tanks is In the agitating portion of the flocculation treatment.

Figure 2:
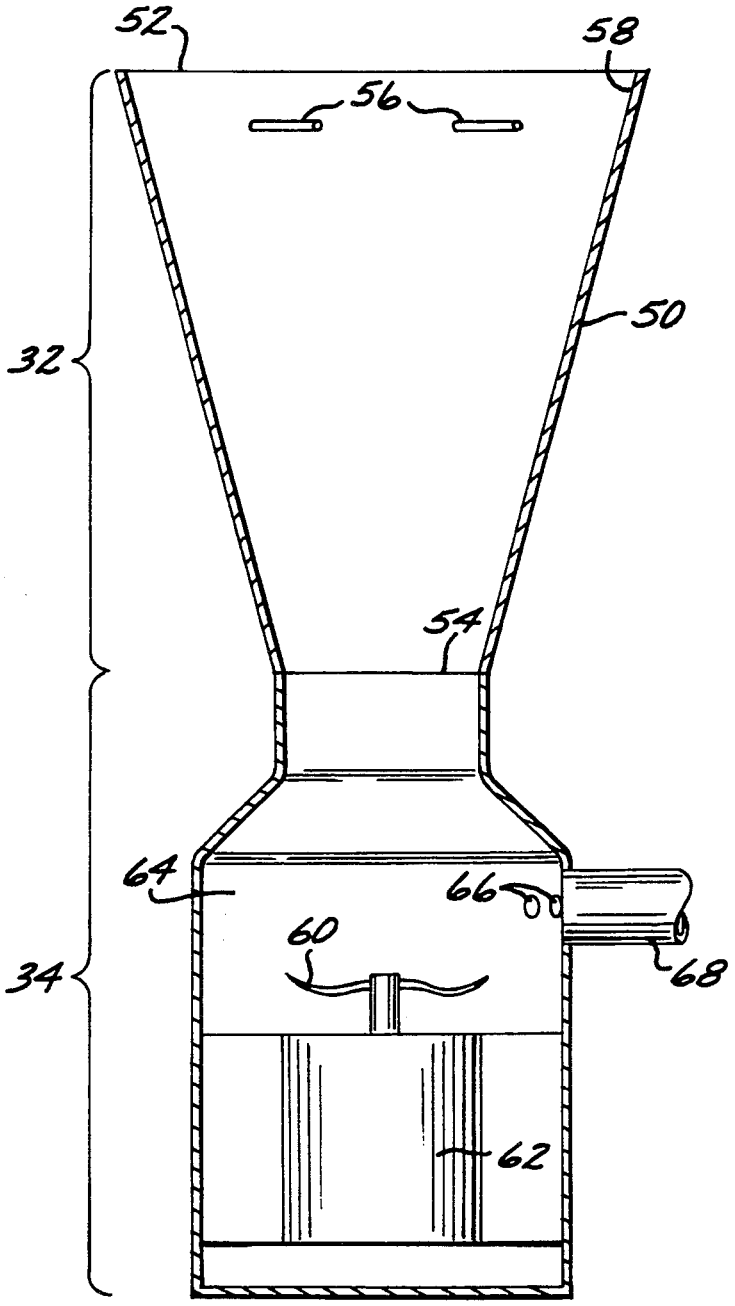
FIG. 2 is a side sectional view of the first and second mixers of FIG. 1, taken along line 2—2.

The preferred forms of the first mixer 32 and the second mixer 34 are shown in FIG. 2. The first mixer 32 is a low-energy mixer having no impeller, wherein the solid material being dispensed is initially mixed with a flow of water. The first mixer 32 is structured as a truncated cone 50 with an open upper end 52 and an open lower end 54, the diameter of the lower end 54 being smaller than the diameter of the upper end 52. There is at least one, and preferably at least several, water inlet openings 56 located near the upper end 52 and arranged so as to direct a flow of water tangentially against an inner conical surface 58 of the cone 50. The tangential flow of water creates a vortex effect within the conical surface of the first mixer 32. The solid material is dropped as a continuous flow from the metering unit 26 onto the inner conical surface 58, where it is mixed into the water by the vortex action. The relative amounts of the solid material and the water are not critical, as long as the resulting mixture has a proper viscosity to be further mixed as discussed next.

The mixture of solid material and water resides in the first mixer 32 only very briefly to permit the solid material to be dispersed into the water flow. The mixture flows from the first mixer 32 directly downwardly into the second mixer 34.

The second mixer 34 is desirably a high-energy mixer having an impeller 60 driven by a high-speed motor 62. The motor desirably turns the impeller with a rotational tip speed of about 25 feet per second or more, so that a large amount of energy is imparted from the impeller 60 into the liquid mixture. The mixture is received from the first mixer 32 into a second mixer mixing chamber 64, into which the impeller 60 extends. The mixture is further mixed to ensure wetting of the water to the solid material. However, the mixture is not intentionally retained for any substantial period of time in the mixer, because the chemical linking action of the hydratable material begins soon after the mixing with water. To the contrary, it is the intent to quickly convey the mixture through the second mixer 94 and to the tank 36.

At least one, and preferably at least several, outlet openings 66 are disposed in the wall of the mixing chamber 64. The outlet openings 66 are aligned and in communication with an outlet pipe 68 that leads to the tank 36. The mixture of material being dispensed and water, formed in the first mixer 32 and further mixed in the second mixer 34, is directed toward the outlet openings 66 by the action of the impeller 60. The mixture is forced through the outlet openings 66 and into the outlet pipe 68, and thence to the tank 36.

In a working embodiment of the invention, a modified commercial garbage disposal was used as the second mixer 94. The disposal was modified in two ways. First, the automatic reverse feature found in many garbage disposals was disabled, so that the impeller of the garbage disposal always turned in a single direction. Second, the upper end of the disposal 94 was modified so that the lower end 54 of the first mixer 92 extended downwardly into the mixing chamber 64, in the manner shown. This modification resulted in an extreme degree of cavitation within the mixing chamber 64, contributing to the high-energy environment of the mixing chamber 64 caused by the rotating impeller 60. The motor 62 was operated at a speed such that the tip speed of the impeller 60 was at least 25 feet per second. In the preferred design, the motor speed was at least about 1700 revolutions per minute. The outlet openings 66 had a diameter of $\frac{1}{8}$ inch. This second mixer 34 functioned in the manner discussed above.

The rapid mixing and wetting inherent in the rapid continuous flow through the first mixer 32 and second mixer 34 minimizes the formation of self-agglomerated lumps ("fisheyes") of the material being dispensed. However, it is possible that on some occasions fisheyes may form in the mixture before it leaves the second mixer 34. An important function of the outlet openings 66 is therefore to prevent the passage to the tank 36 of any "fisheyes" that may be formed in the first mixer 32 or second mixer 34. Accordingly, the outlet openings 66 are sized to be less than a preselected size, so that fisheyes of this size or larger cannot pass through. The preselected size can be any value chosen, but is typically about ⅛ inch. To accomplish this function, the outlet openings 66 can be individual small openings, or can be larger openings with a size discriminating device such as a screen with a mesh opening of the preselected size.

If fisheyes do form but do not pass through the outlet openings 66, they are retained within the mixing chamber 64. They are further subjected to the high-energy action of the impeller 60 and comminuted to a smaller form that will pass through the openings 66. Thus, large, ineffective lumps of the material being dispensed cannot reach the fluid in the tank 36. If the fisheyes are not comminuted, they remain in the mixing chamber 64 and are removed during periodic cleaning.

Figure 3:
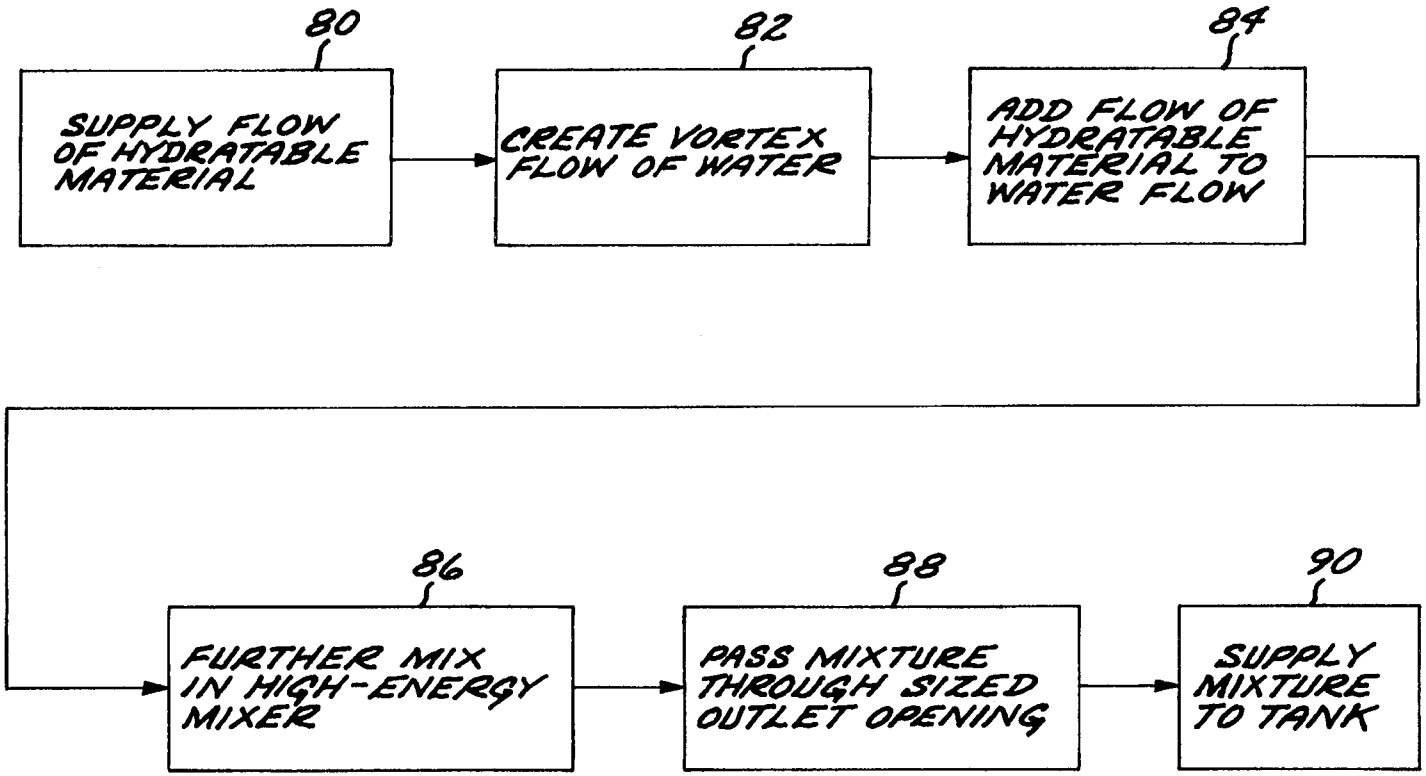
FIG. 3 is a block diagram for a process according to the invention.

FIG. 3 illustrates a preferred process for practicing the invention. A flow of hydratable material, such as a flocculant, is supplied, numeral 80. The hydratable material is mixed with water to begin the wetting process, in a low-energy mixing operation. To do so, a vortex is created in a water flow, numeral 82, and the flow of hydratable material is added to the vortex of the water flow, numeral 84.

The mixture is conveyed continuously and directly to a high-energy mixer, numeral preferably of the high-speed impeller type discussed previously. The mixture is further mixed briefly and continuously in the high-energy mixer, and passed through outlet openings of a size less than a preselected size, numeral 88. The rapid and continuous mixing minimizes the changes of self-agglomeration of the hydratable material into fisheyes. If, however, any fisheyes form, the outlet openings prevent them from reaching the fluid to which dispensing is occurring. After passing through the outlet openings, the mixture is introduced immediately and continuously into a low-energy environment of a fluid mass, preferably in a mixing tank, numeral 90.

The apparatus and the method of the invention have been practiced successfully. A dispensing apparatus according to the present invention and as discussed herein was built and operated. For comparison, a conventional dispensing apparatus was operated. Over a period of several days, it was determined that there was a savings of about 10 percent in flocculant usage when flocculant was dispensed according to the present invention as compared with the conventional approach.

Although a particular embodiment of the invention has been described in detail for purposes of illustration, various modifications may be made without departing frown the spirit and scope of the invention. Accordingly, the invention is not to be limited except as by the appended claims.

What is claimed is:

1. Apparatus for dispensing a hydratable material , comprising:
- a source of the hydratable material to be dispensed;
- a continuous-flow first mixer comprising a hydratable material inlet and a water inlet, the hydratable material inlet and the water inlet being disposed to mix a flow of the hydratable material and a flow of water to produce a flow of a mixture of hydratable material and water; and
- a continuous-flow second mixer positioned directly adjacent to the first mixer , and which second mixer receives the flow of mixture from the first mixer and includes
- a mixing chamber,
- at least one outlet opening in the wall of the mixing chamber of a size less than a preselected acceptable size of an agglomeration of the hydratable material,
- an impeller disposed to mix the mixture of hydratable material and water and force the mixture rapidly through the mixing chamber and toward the outlet opening so that the mixture is not retained within the mixing chamber.

2. The apparatus of claim 1, wherein the source includes
- a container of the hydratable material, and
- a metering unit that transfers a controllable flow of the hydratable material from the container to the first mixer.

3. The apparatus of claim 1, wherein the first mixer comprises a truncated cone having an open upper end and an open lower end of smaller diameter than the upper end.

4. The apparatus of claim 3, wherein the water inlet includes at least one opening at an upper end of an inner surface of the cone, disposed so as to introduce water tangentially along the inner circumference of the cone to create a vortex effect within the cone.

5. The apparatus of claim 3, wherein the water inlet includes a plurality of openings at an upper end of an inner surface of the cone, disposed so as to introduce water tangentially along the inner circumference of the cone to create a vortex effect within the cone.

6. The apparatus of claim 1, wherein the second mixer further includes
- a motor that turns the impeller such that the tip speed of the impeller is at least about 25 feet per second.

7. The apparatus of claim 1, wherein the second mixer is a garbage disposal unit.

8. The apparatus of claim 1, further including
- a tank which receives the flow of mixture from the second mixer.

9. The apparatus of claim 1, wherein the source is disposed vertically above the first mixer, and the first mixer is disposed vertically above the second mixer.

10. The apparatus of claim 1, wherein the preselected size of the outlet opening of the second mixer is about ⅛ inch.

11. Apparatus for dispensing a hydratable material, comprising:
- a source of the hydratable material to be dispensed, the source including
- a container adapted to contain a supply of the hydratable material, and
- a metering unit that transfers a controllable flow of the hydratable material from the container;
- a continuous-flow first mixer comprising
  - a truncated conical mixing chamber having an open upper end and an open lower end of smaller diameter than the upper end, the upper end being disposed to receive the controllable flow frown the metering unit and the lower end delivering a flow of a mixture of the hydratable material and water, and
  - a plurality of water inlet openings at an upper end of an inner surface of the conical mixing chamber, the openings being disposed so as to introduce water tangentially along the inner circumference of tile conical mixing chamber to create a vortex effect within the conical mixing chamber;

a continuous-flow second mixer positioned directly adjacent to and below the first mixer, and which second mixer receives the flow of mixture from the first mixer, the second mixer including at least one outlet opening of a size less than a preselected size, an impeller disposed to mix the mixture of hydratable material and water and force the mixture toward the outlet opening, and a motor that turns the impeller such that the tip speed of the impeller is at least about 25 feet per second.

12. The apparatus of claim 11, wherein the hydratable material is a solid prior to dispensing, and the container of the source is a hopper.

13. The apparatus of claim 11, wherein the preselected size of the outlet opening of the second mixer is about $\frac{1}{8}$ inch.

14. The apparatus of claim 11, wherein the second mixer is a garbage disposal unit.

15. The apparatus of claim 11, further including a tank which receives the flow of mixture from the second mixer.

16. A method for dispensing a hydratable material into a body of fluid, comprising the steps of:

supplying a hydratable material;

mixing the hydratable material with water in a continuous-flow first mixer;

further mixing the mixture of hydratable material and water in a continuous-flow second mixer, second mixer being disposed immediately adjacent the first mixer and including mechanical means for agitating the mixture and for forcing the mixture through the second mixer to avoid the retention of the mixture within the second mixer;

passing the mixture flowing from the second mixer through an outlet opening having a size less than a preselected acceptable size of an agglomeration of the hydratable material; and supplying the mixture of hydratable material and water directly and continuously from the high-energy mixer to the body of fluid.

17. The method of claim 16, wherein the step of mixing includes the steps of creating a vortex flow of water, and adding a flow of the hydratable material to the vortex.

18. The method of claim 16, wherein the step of further mixing includes the step of contacting the mixture with an impeller that turns with a tip speed of at least about 25 feet per second.

* * * * *